US011540961B2

(12) United States Patent
Chung

(10) Patent No.: US 11,540,961 B2
(45) Date of Patent: Jan. 3, 2023

(54) MODULAR BED WITH VIBRATION MOTOR

(71) Applicant: ULIFE HEALTHCARE INC., Taoyuan (TW)

(72) Inventor: Ya-Hsin Chung, Taichung (TW)

(73) Assignee: ULIFE HEALTHCARE INC., Taoyuan (TW)

( * ) Notice: Subject to any disclaimer, the term of this patent is extended or adjusted under 35 U.S.C. 154(b) by 297 days.

(21) Appl. No.: 16/827,266

(22) Filed: Mar. 23, 2020

(65) Prior Publication Data

US 2021/0121345 A1 Apr. 29, 2021

(30) Foreign Application Priority Data

Oct. 25, 2019 (TW) ..... 108214066

(51) Int. Cl.

| | |
|---|---|
| ***A61G 7/015*** | (2006.01) |
| ***A61H 23/02*** | (2006.01) |
| ***A47C 19/02*** | (2006.01) |
| ***A61H 1/00*** | (2006.01) |

(52) U.S. Cl.

CPC ..... *A61G 7/015* (2013.01); *A47C 19/02* (2013.01); *A61H 1/005* (2013.01); *A61H 23/0254* (2013.01); *A61H 2201/0142* (2013.01)

(58) Field of Classification Search

CPC ..... A61G 7/015; A47C 19/02; A47C 21/006; A61H 23/0254; A61H 2201/0142; A61H 1/005; A61H 23/00; A61H 2201/0165

See application file for complete search history.

(56) References Cited

U.S. PATENT DOCUMENTS

| | | | | |
|---|---|---|---|---|
| 2007/0163046 | A1* | 7/2007 | Eriksson | A47C 20/041 5/618 |
| 2015/0313369 | A1* | 11/2015 | Tarplee | A61H 23/0254 601/57 |
| 2016/0113410 | A1* | 4/2016 | Ermalovich | A61G 13/009 248/316.6 |
| 2018/0125249 | A1* | 5/2018 | Chung | A47C 19/021 |

* cited by examiner

*Primary Examiner* — David R Hare

*Assistant Examiner* — Deborah Talitha Gedeon

(74) *Attorney, Agent, or Firm* — Schwegman Lundberg & Woessner, P.A.

(57) ABSTRACT

A modular bed includes a frame assembly, a plurality of elongated support units, and at least one vibration assembly including a rack, a stretchable web, and a vibration motor. The rack is detachably mounted on two selected adjacent ones of the elongated support units. The stretchable web has a central portion suspended across a lower opening of the rack. After the through bore is stretched to permit insertion of a positioning plate of the vibration motor, resilient retraction of the through bore causes a neck portion of the vibration motor to be trapped in the through bore with a motor body and the positioning plate of the vibration motor to be in abutting engagement with upper and lower surfaces of the stretchable web, respectively.

16 Claims, 10 Drawing Sheets

MODULAR BED WITH VIBRATION MOTOR

CROSS-REFERENCE TO RELATED APPLICATION

This application claims priority from Taiwanese utility model patent application no. 108214066, filed on Oct. 25, 2019.

FIELD

The disclosure relates to a furniture bed, more particularly to a modular bed with at least one vibration motor.

BACKGROUND

As shown in FIG. 1, a conventional massage bed 9 disclosed in Taiwanese utility model patent no. M418685 includes a support panel 92 for supporting a bed mattress 91, and a vibration motor 94 which is secured to the support panel 92 by means of screws 93, and which is provided for massaging a user lying on the bed mattress 91.

However, because the vibration motor 94 is fixedly secured in a through hole of the support panel 92, the transmission of the vibration from the vibration motor 94 to the bed mattress 91 is limited. In addition, the installation of the vibration motor 94 is relatively complicated.

SUMMARY

Therefore, an object of the disclosure is to provide a novel modular bed which may have an improved vibration effect. Furthermore, in the novel modular bed, a vibration assembly may be detachably mounted on a frame assembly at a desired position.

According to the disclosure, a modular bed includes a frame assembly, a plurality of elongated support units, and at least one vibration assembly. The elongated support units are mounted on the frame assembly, and are displaced from each other in a longitudinal direction. Each of the elongated support units extends in a transverse direction relative to the longitudinal direction. The vibration assembly includes a rack, a stretchable web, and a vibration motor. The rack is detachably mounted on two selected adjacent ones of the elongated support units, and having a lower opening. The stretchable web has an upper surface and a lower surface, and includes a central portion which has a through bore, and two lateral portions which are at two opposite sides of the central portion and which are coupled to the rack to permit the central portion to be suspended across the lower opening. The vibration motor includes a motor body, a positioning plate which has a dimension larger than a dimension of the through bore, and a neck portion which is coupled between the motor body and the positioning plate such that after the through bore is stretched to permit the positioning plate to be inserted through the stretched through bore, resilient retraction of the through bore causes the neck portion to be trapped in the through bore with the motor body and the positioning plate to be in abutting engagement with the upper and lower surfaces of the stretchable web, respectively.

BRIEF DESCRIPTION OF THE DRAWINGS

Other features and advantages of the disclosure will become apparent in the following detailed description of the embodiment (s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
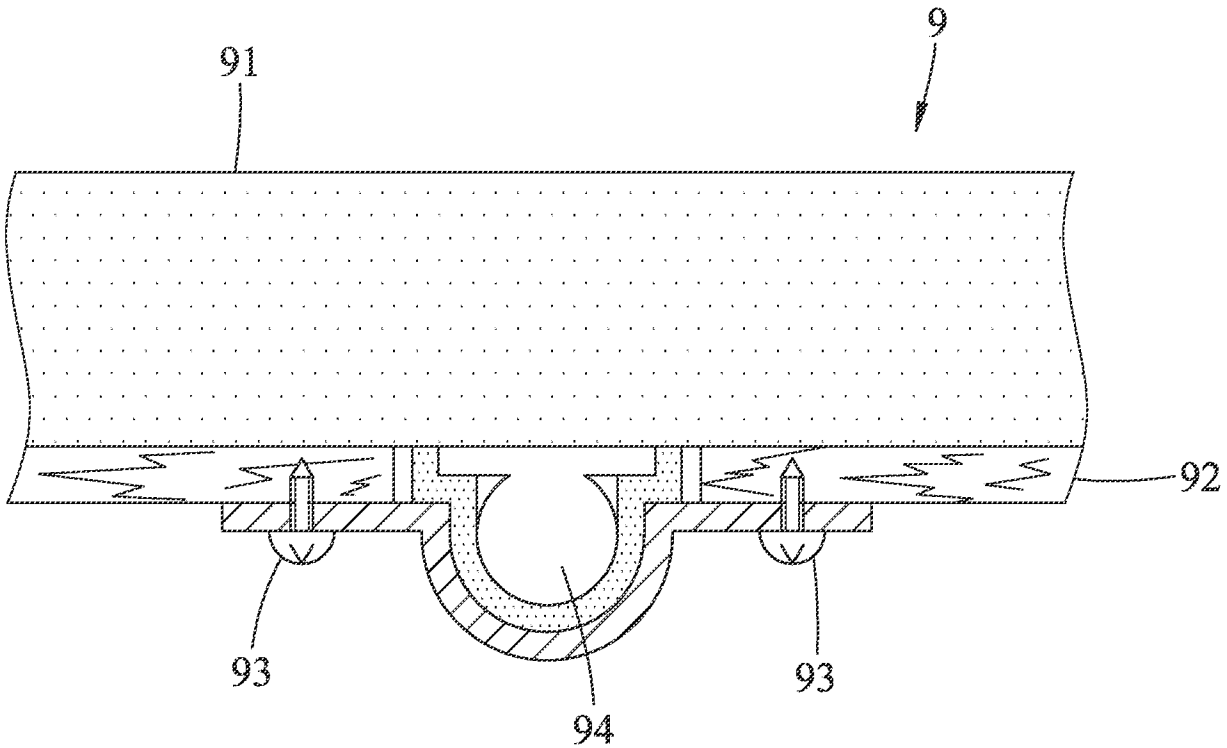
FIG. 1 PRIOR ART
FIG. 1 is a fragmentary cross-sectional view of a conventional massage bed.
Figure 2:
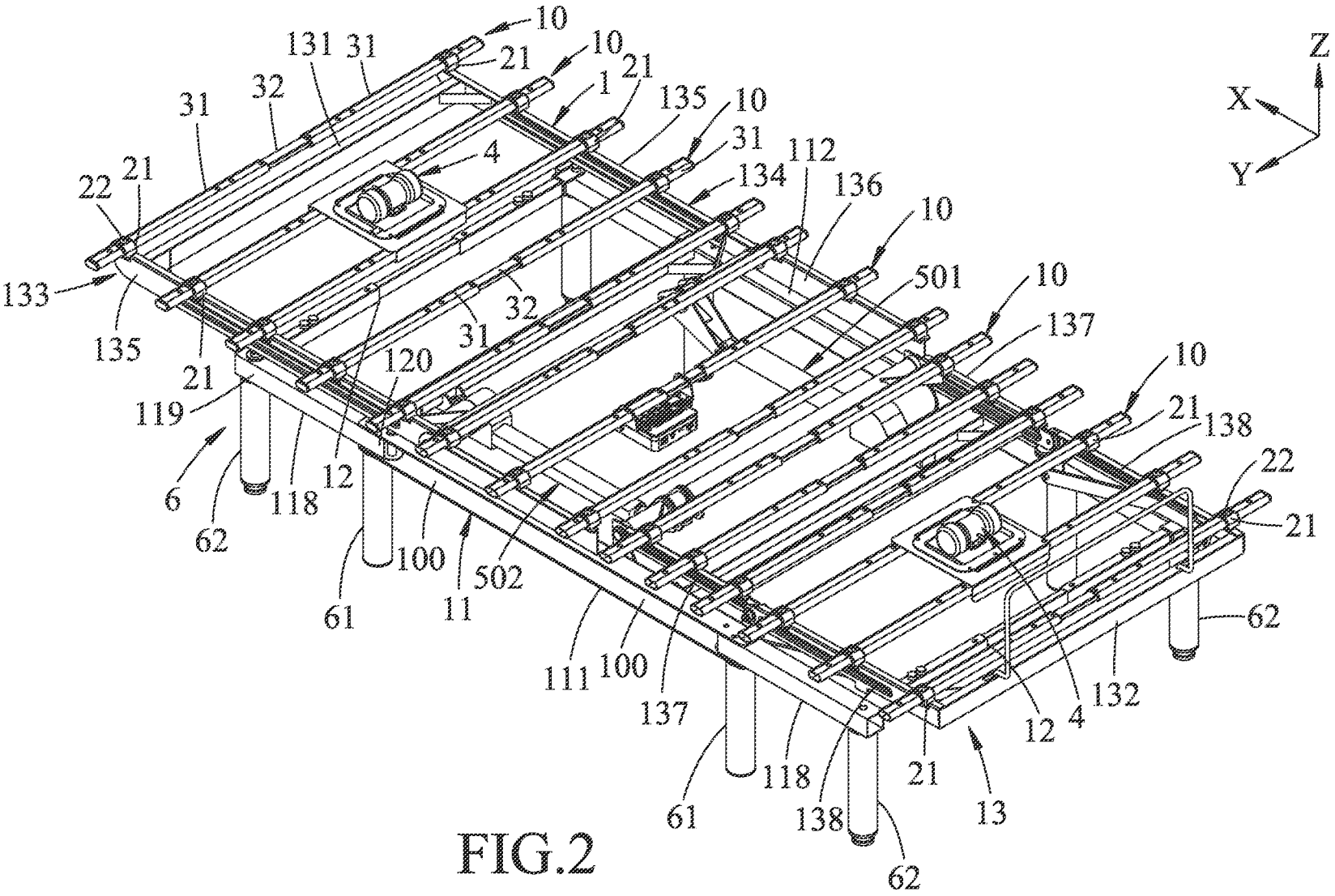
FIG. 2 is a perspective view of a modular bed according to an embodiment of the disclosure.
Figure 3:
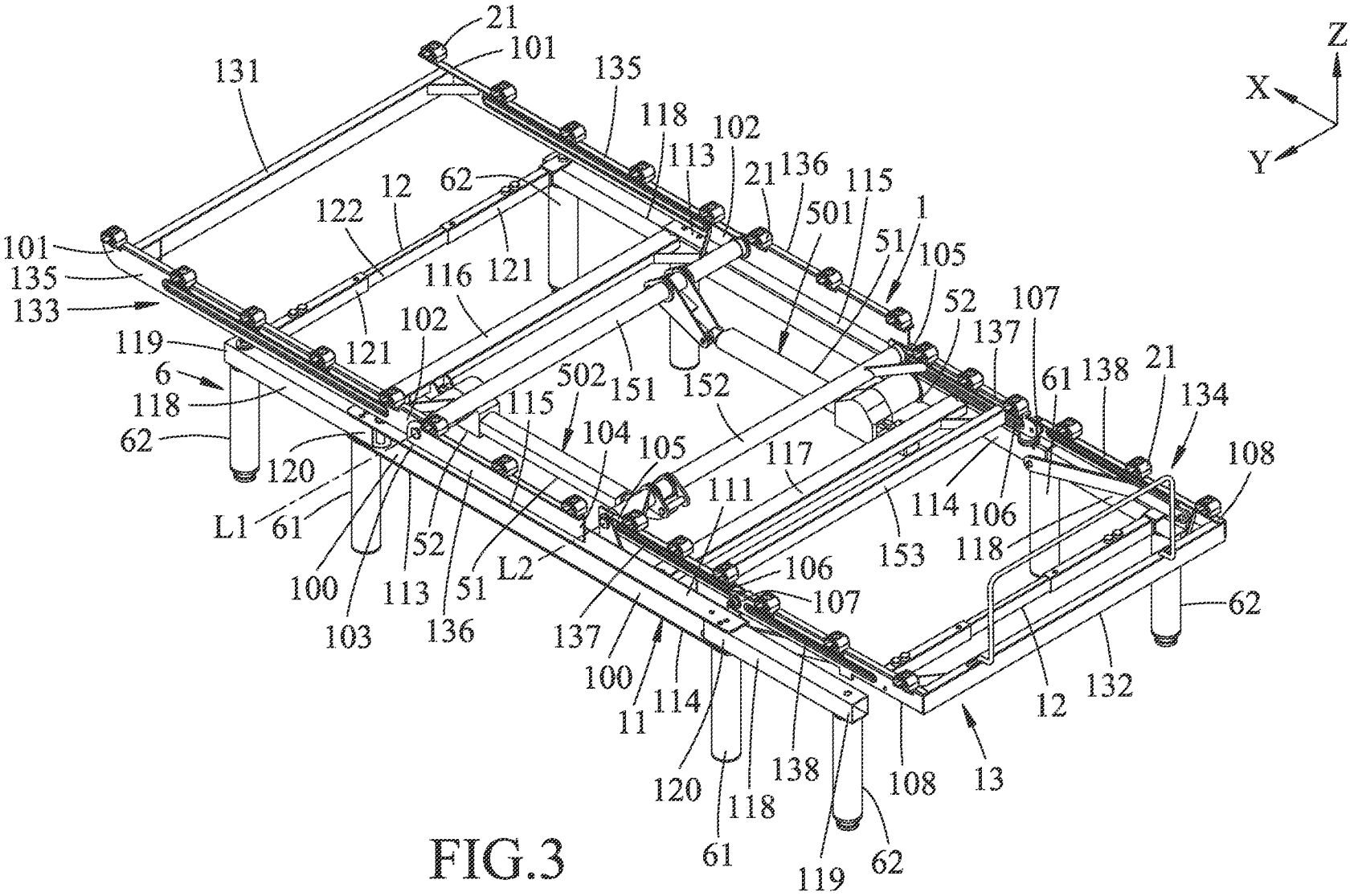
FIG. 3 is similar to FIG. 2 but omitting inner and outer tubes of elongated support units.
Figure 9:
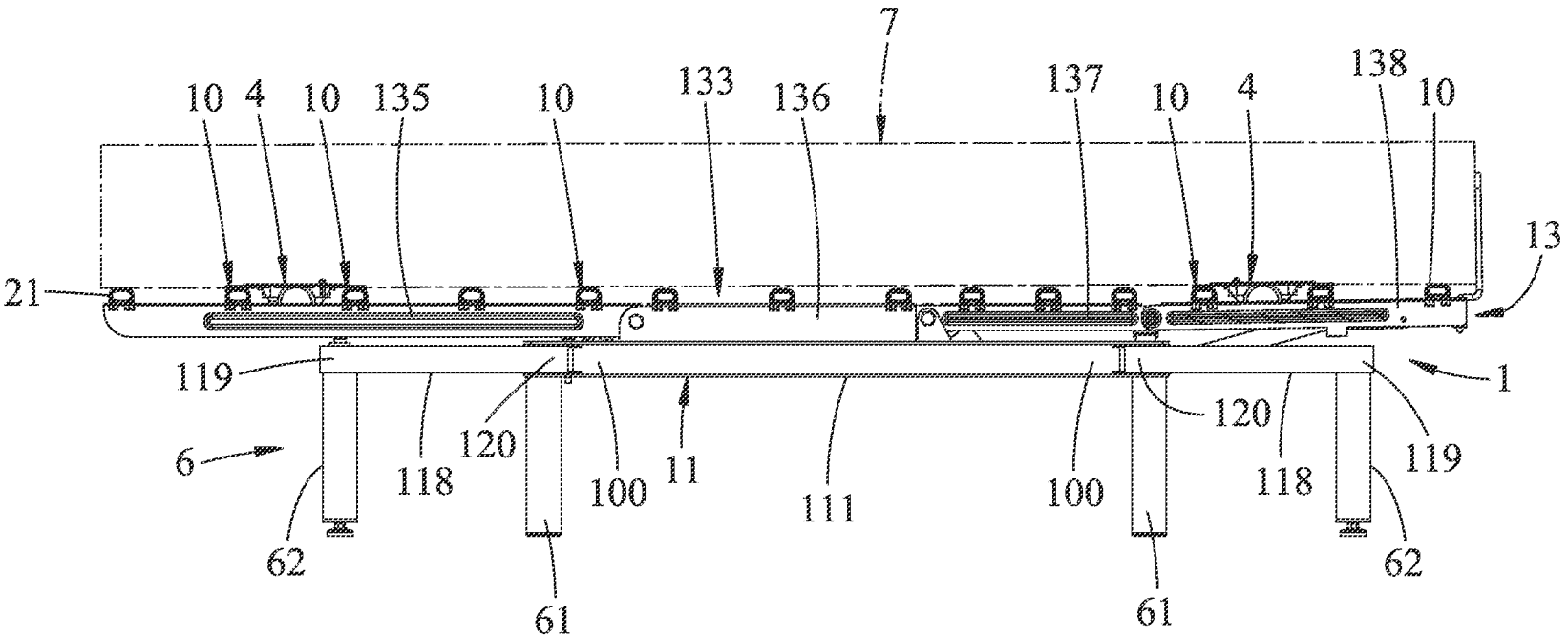
FIG. 9 is a side view of FIG. 2 illustrating linkages of the modular bed in a support position.

With reference to FIGS. 2 and 3, a modular bed according to an embodiment of the disclosure is shown to include a frame assembly 1, a plurality of support units 10, and at least one vibration assembly 4. As shown in FIG. 9, the elongated support units 10 may be provided for supporting a bed mattress 7.

Each of the elongated support units 10 are mounted on the frame assembly 1, and are displaced from each other in a longitudinal direction (X). Each of the elongated support units 10 extends in a transverse direction (Y) relative to the longitudinal direction (X).

Figure 8:
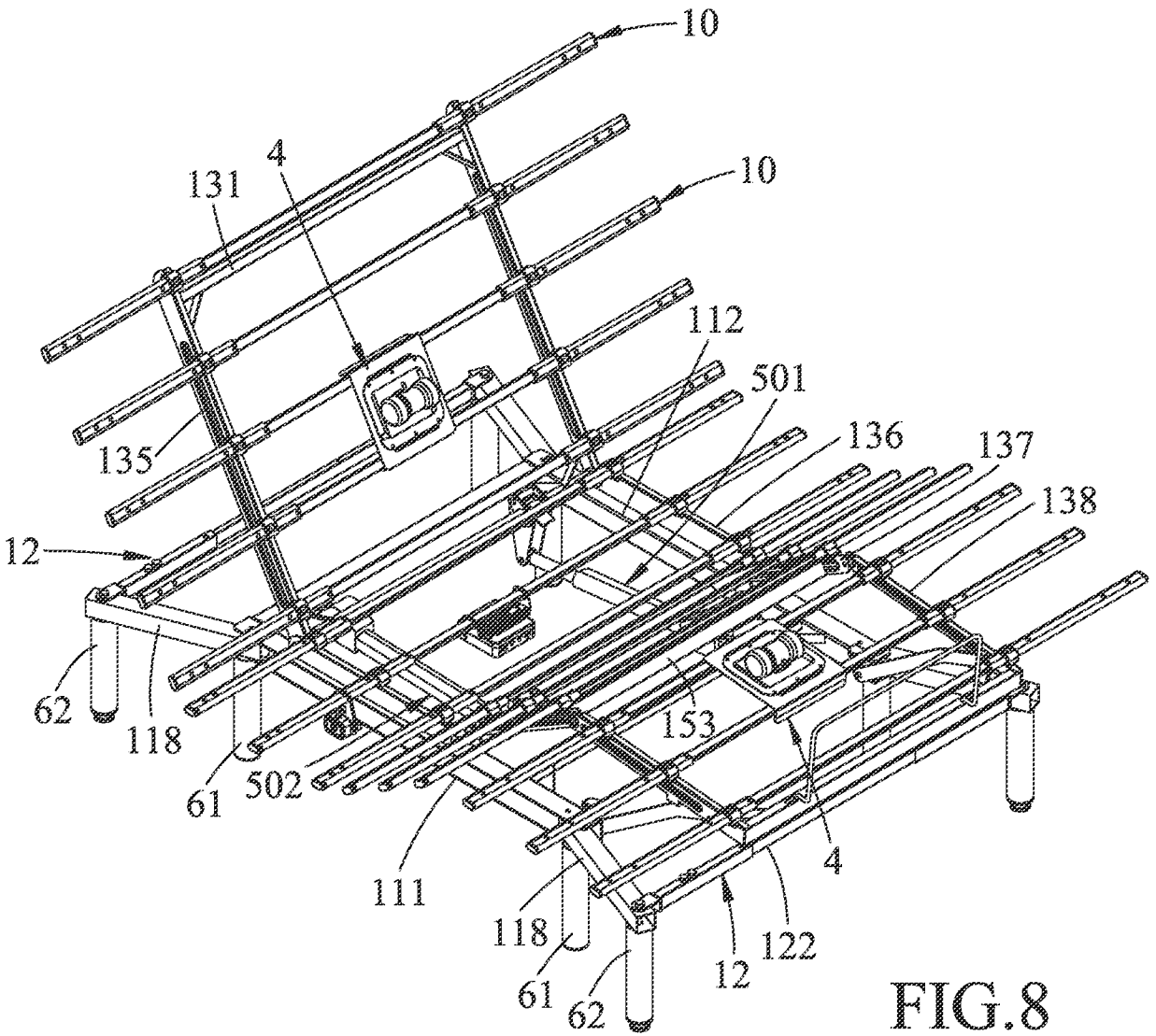
FIG. 8 is a perspective view of the modular bed illustrating a front bar in a head elevated position and a third middle bar in a leg elevated position.

In an embodiment shown in FIGS. 2, 3, and 8, each of the elongated support units 10 includes an inner tube 32 and two outer tubes 31. The inner tube 32 has two opposite end segments in the transverse direction (Y). The outer tubes 31 are slidably sleeved on the end segments of the inner tube 32, respectively, and are slidably retained on the frame assembly 1. Each of the outer tubes 31 may be slidable between a retracted position (FIG. 2) and an extended position (FIG. 8) relative to the frame assembly 1. Each of the elongated support units 10 may further include two retaining shells 21 and two positioning members 22. The retaining shells 21 are detachably mounted on the frame assembly 1 and are spaced apart from each other in the transverse direction (Y). The positioning members 22 are detachably coupled to the retaining shells 21, respectively. The two outer tubes 31 may be slidably and respectively retained by the retaining shells 21, and may be positioned respectively by the positioning members 22 when in the retracted position or the extended position. When the outer tubes 31 of each of the elongated support units 10 are close to each other in the retracted position (FIG. 2), the modular bed is suitable for supporting a smaller bed mattress. When the outer tubes 31 of each of the elongated support units 10 are remote from each other in the extended position (FIG. 8), the modular bed is suitable for supporting a larger bed mattress.

The vibration assembly 4 includes a rack 41, a stretchable web 42, and a vibration motor 45.

The rack 41 is detachably mounted on two selected adjacent ones of the elongated support units 10, and has a lower opening 410. In an embodiment shown in FIGS. 4 to 6, the rack 41 may have a plate segment 411, a first bent end segment 414, and a second bent end segment 415. The plate segment 411 has the lower opening 410, and extends in the longitudinal direction (X) to terminate at a first end region 412 and a second end region 413. The first and second bent end segments 414, 415 are connected to the first and second end regions 412, 413 of the plate segment 411, respectively, and are configured to detachably engage the two selected adjacent ones of the elongated support units 10, respectively.

Figure 4:
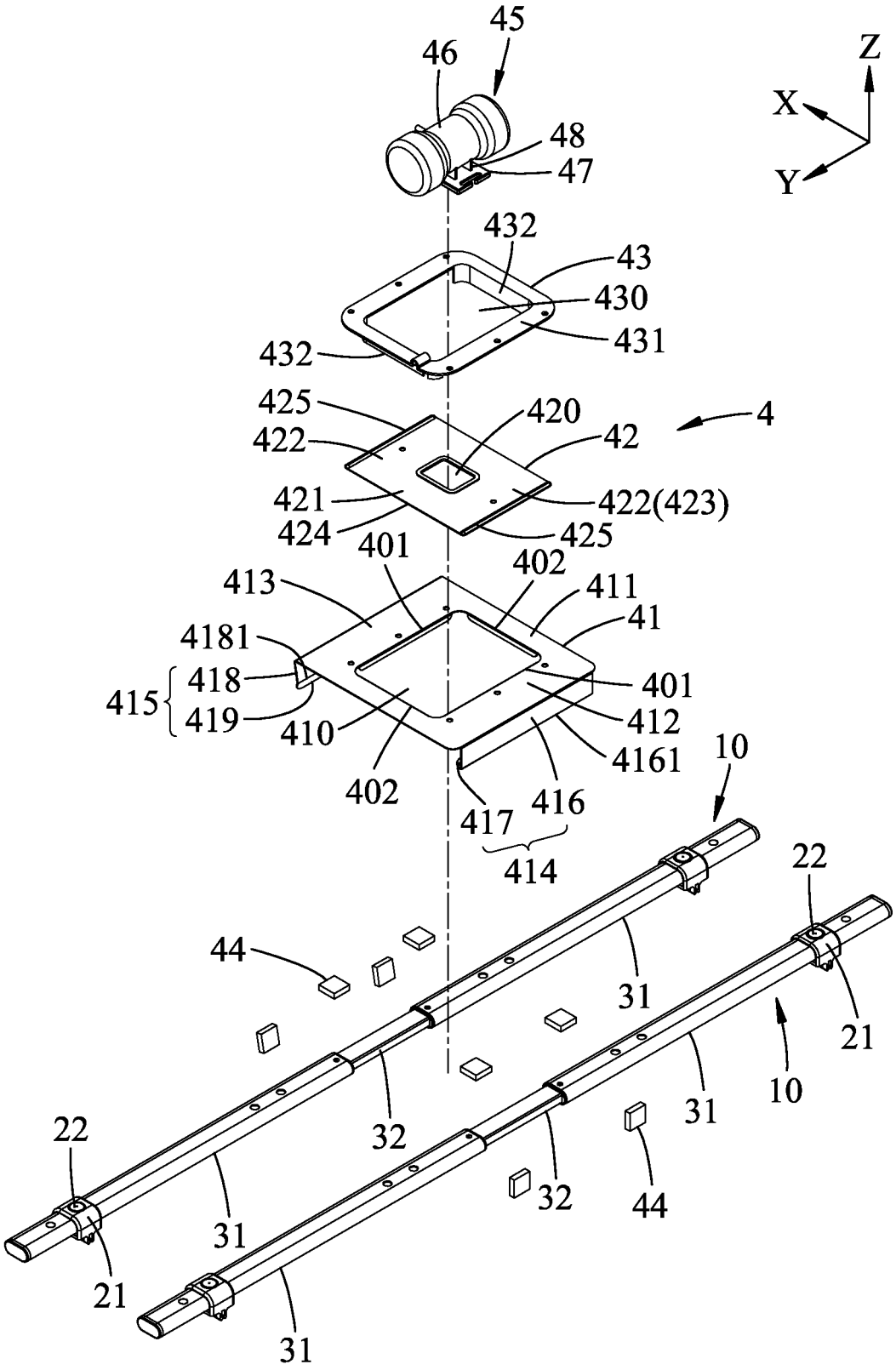
FIG. 4 is a partially exploded perspective view illustrating a vibration assembly and two selected adjacent ones of the elongated support units in the modular bed.
Figure 5:
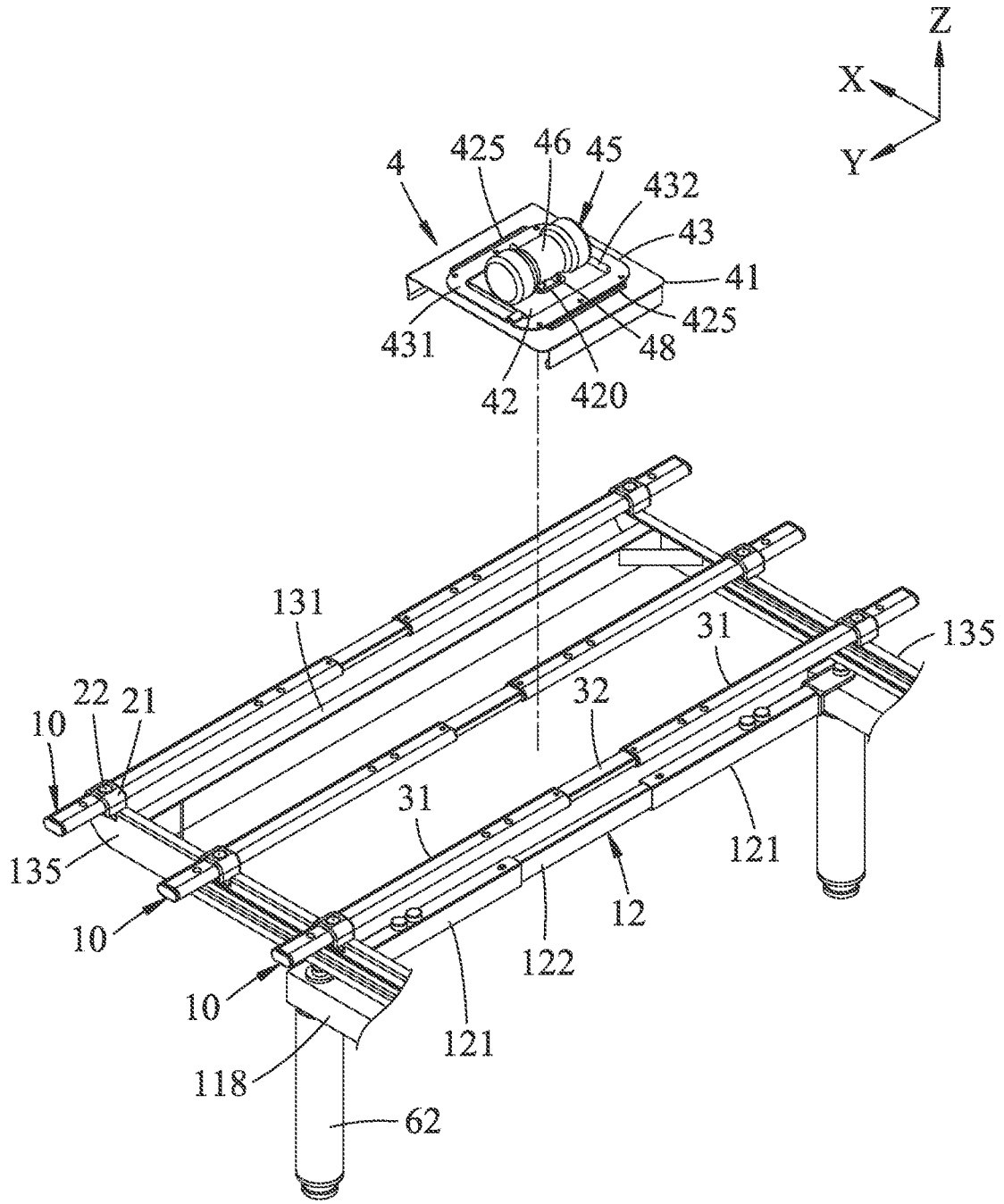
FIG. 5 is a fragmentary, partially exploded perspective view of the modular bed.
Figure 6:
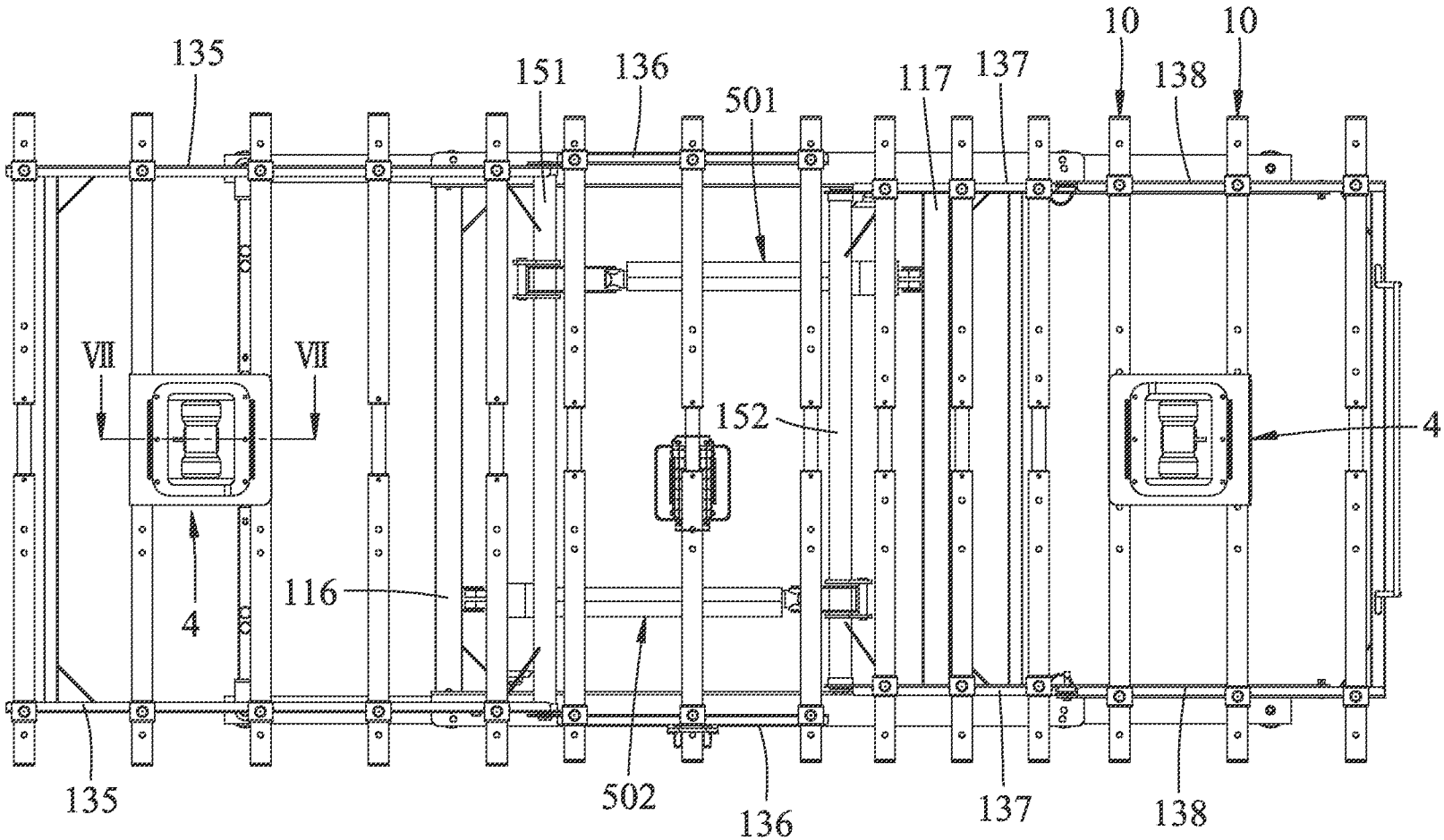
FIG. 6 is a top view of the modular bed.
Figure 7:
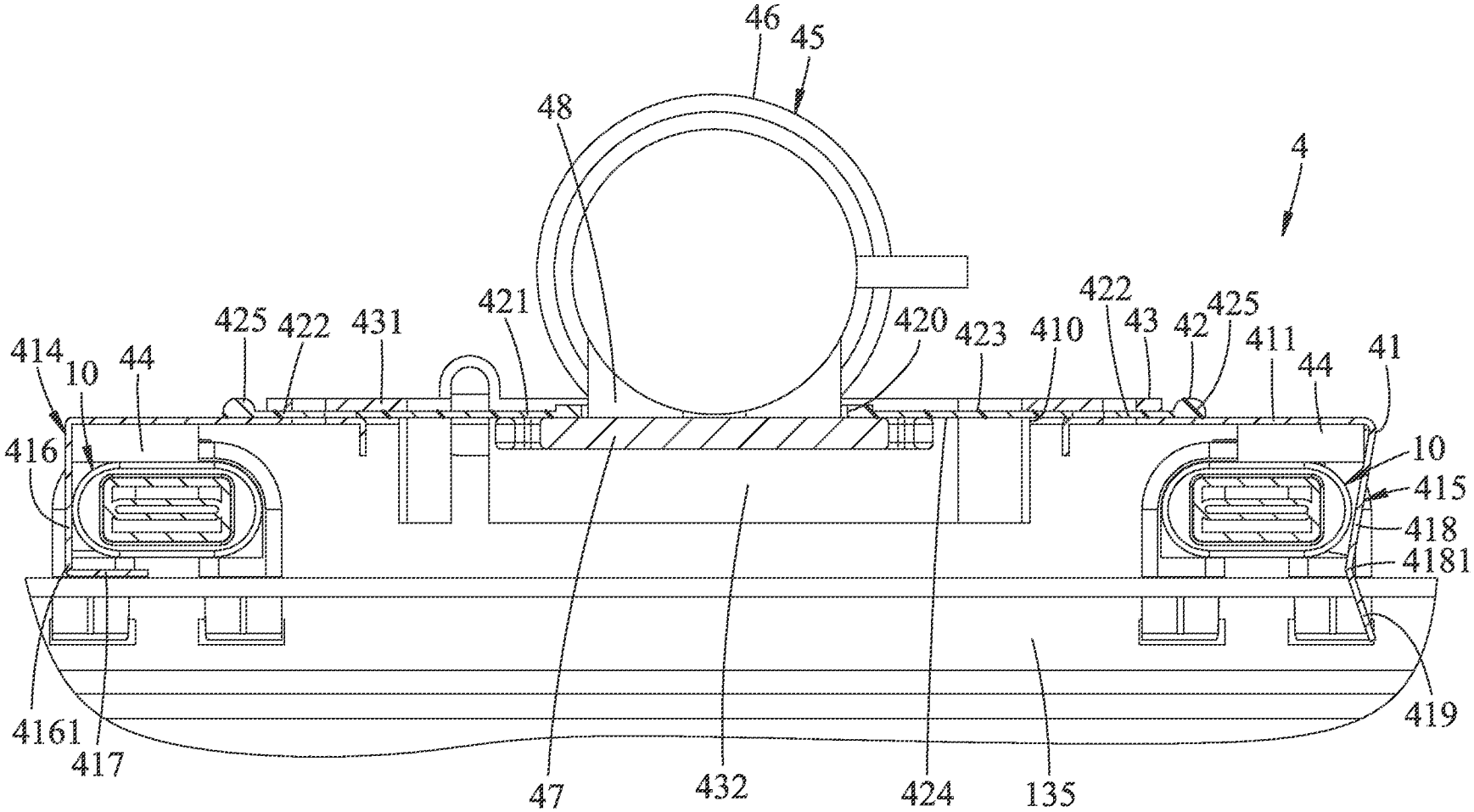
FIG. 7 is a fragmentary cross-sectional view taken along line VII-VII of FIG. 6.

In an embodiment shown in FIGS. 4 to 6, the first bent end segment 414 may include a first vertical region 416 and a first marginal region 417. The first vertical region 416 extends downwardly from the first end region 412 of the plate segment 411 to terminate at a first lower end 4161. The first marginal region 417 extends from the first lower end 4161 to bend toward the second bent end segment 415 so as to permit the first bent end segment 414 to hook on one of the two selected adjacent ones of the elongated support units 10. The second bent end segment 415 may include a second vertical region 418 and a second marginal region 419. The second vertical region 418 extends downwardly from the second end region 413 of the plate segment 411 to terminate at a second lower end 4181. The second marginal region 419 extends from the second lower end 4181 to bend away from the first bend end segment 414 so as to permit the second bent end segment 415 to resiliently retain the other one of the two selected adjacent ones of the elongated support units 10, thereby allowing the rack 41 to be detachably mounted on the two selected adjacent ones of the elongated support units 10.

In an embodiment shown in FIGS. 4 and 6, the plate segment 411 may have two first inner margins 401 and two second inner margins 402. The first inner margins 401 are opposite to each other in one of the longitudinal and transverse directions (X, Y). The second inner margins 402 are opposite to each other in the other one of the longitudinal and transverse directions (X, Y).

The first and second inner margins 401, 402 cooperatively define the lower opening 410. In FIG. 4, the first inner margins 401 are opposite to each other in the longitudinal direction (X) and the second inner margins 402 are opposite to each other in the transverse direction (Y).

The stretchable web 42 has an upper surface 423 and a lower surface 424, and includes a central portion 421 and two lateral positions 422. The central portion 421 has a through bore 420. The lateral portions 422 are at two opposite sides of the central portion 421 and are coupled to the rack 41 to permit the central portion 421 to be suspended across the lower opening 410. In an embodiment shown in FIGS. 4 and 6, the two lateral portions 422 of the stretchable web 42 are disposed on the plate segment 411 to cover the first inner margins 401, respectively.

The vibration motor 45 includes a motor body 46, a positioning plate 47 which has a dimension larger than a dimension of the through bore 420, and a neck portion 48 which is coupled between the motor body 46 and the positioning plate 47. After the through bore 420 is stretched to permit the positioning plate 47 to be inserted through the stretched through bore 420, resilient retraction of the through bore 420 causes the neck portion 48 to be trapped in the through bore 420 with the motor body 46 and the positioning plate 47 to be in abutting engagement with the upper and lower surfaces 423, 424 of the stretchable web 42, respectively.

In an embodiment shown in FIGS. 4 and 6, the vibration assembly 4 may further include a retaining frame 43 having an upper frame body 431 and two inserts 432. The upper frame body 431 has an upper opening 430. The inserts 432 are mounted beneath the upper frame body 431.

When the upper frame body 431 is disposed on the stretchable web 42 to register the upper opening 430 with the lower opening 410, the inserts 432 are permitted to insert through the lower opening 410 to be respectively brought into mating engagement with the second inner margins 402, thereby allowing the lateral portions 422 of the stretchable web 42 to be coupled to the rack 41 and to be retained between the retaining frame 43 and the rack 41.

In an embodiment shown in FIGS. 4 to 6, the lateral portions 422 of the stretchable web 42 may have respectively two enlarged margins 425. When the stretchable web 42 is retained between the retaining frame 43 and the rack 41, the enlarged margins 425 are kept at two opposite sides of the upper frame body 431, to thereby ensure the vibration motor 45 to be suspended by the stretchable web 42 across the lower opening 410.

In an embodiment shown in FIGS. 4 and 6, the vibration assembly 4 may further include a plurality of cushion pads 44 each of which is disposed between the corresponding elongated support unit 10 and the rack 41.

In an embodiment shown in FIG. 2, the modular bed may include two of the vibration assemblies 4 which are spaced apart on the frame assembly 1 in the longitudinal direction (X).

Please note that because the rack 41 of each of the vibration assemblies 4 may be detachably mounted on any two selected adjacent ones of the elongated support units 10, each of the vibration assemblies 4 may be mounted on the frame assembly 1 at a desired position based on user requirement.

In an embodiment shown in FIG. 3, the frame assembly 1 may include a support frame 13 having a front bar 131, a rear bar 132, a left bar unit 133, and a right bar unit 134. Each of the front and rear bars 131, 132 extends in the transverse direction (Y) to terminate at a left bar end and a right bar end. The left bar unit 133 extends in the longitudinal direction (X) to interconnect the left bar ends of the front and rear bars 131, 132. The right bar unit 134 extends in the longitudinal direction (X) to interconnect the right bar ends of the front and rear bars 131, 132. The retaining shells 21 of each of the elongated support units 10 are detachably and respectively mounted to the left and right bar units 133, 134 such that the elongated support units 10 are mounted on the left and right bar units 133, 134 to be displaced from each other in the longitudinal direction (X).

In an embodiment shown in FIGS. 2 and 3, the frame assembly 1 may further include a base frame 11 configured to support the support frame 13 thereon and having a left beam 111, a right beam 112, a front beam 116, and a rear beam 117. The left and right beams 111, 112 are spaced apart from each other in the transverse direction (Y), and each of the left and right beams 111, 112 has a front end segment 113, a rear end segment 114 opposite to the front end segment 113, and a middle segment 115 between the front and rear end segments 113, 114. The front beam 116 extends in the transverse direction (Y) to interconnect the front end segments 113 of the left and right beams 111, 112. The rear beam 117 extends in the transverse direction (Y) to interconnect the rear end segments 114 of the left and right beams 111, 112.

In an embodiment shown in FIG. 3, each of the left and right bar units 133, 134 may include a first bar 135, a second bar 136, a third bar 137, and a fourth bar 138. The first bar 135 has a first rear end 102 and a first front end 101 which is secured to a respective one of the left and right bar ends of the front bar 131. The second bar 136 is disposed rearwardly of the first bar 135 and is mounted on the middle segment 115 of a respective one of the left and right beams 111, 112. The second bar 136 has a second rear end 104 and a second front end 103. The first rear end 102 is pivotally connected relative to the second front end 103 about a first axis (L1) in the transverse direction (Y). In an embodiment shown in FIG. 3, the first rear end 102 is pivotally connected to the second front end 103. Otherwise, the first rear end 102 may be pivotally connected on the front end segment 113 of the respective one of the left and right beams 111, 112. The third bar 137 is disposed rearwardly of the second bar 136, and has a third rear end 106 and a third front end 105 which is pivotally connected to the middle segment 115 of the respective one of the left and right beams 111, 112 about a second axis (L2) in the transverse direction (Y). The fourth bar 138 has a fourth rear end 108 which is secured to a respective one of the left and right bar ends of the rear bar 132, and a fourth front end 107 which is pivotally connected to the third rear end 106.

In an embodiment shown in FIG. 3, the support frame 13 may further include a first middle bar 151, a second middle bar 152, and a third middle bar 153. The first middle bar 151 interconnects the first rear ends 102 of the first bars 135 of the left and right bar units 133, 134 so as to permit the first bars 135 of the left and right bar units 133, 134 to turn together relative to the base frame 11, thereby allowing turning of the front bar 131 about the first axis (L1). The second middle bar 152 interconnects the third front ends 105 of the third bars 137 of the left and right bar units 133, 134 so as to permit the third bars 137 to turn together relative to the base frame 11. The third middle bar 153 interconnects the third rear ends 106 of the third bars 137 of the left and right bar units 133, 134 so as to permit the third middle bar 153 to turn with the second middle bar 152 about the second axis (L2).

In an embodiment shown in FIGS. 2, 3, 6, 8, the modular bed may further include a first jack member 501 and a second jack member 502. The first jack member 501 is coupled between the first middle bar 151 and the rear beam 117 so as to permit the front bar 131 to be driven by the first jack member 501 to be liftable about the first axis (L1) from a head normal position (FIGS. 2 and 6), where the front bar 131 is close to the ground, to a head elevated position (FIG. 8), where the front bar 131 is remote from the ground. The second jack member 502 is coupled between the second middle bar 152 and the front beam 116 so as to permit the third middle bar 153 to be driven by the second jack member 502 to be liftable about the second axis (L2) from a leg normal position (FIGS. 2 and 6), where the third middle bar 153 is close to the ground, to a leg elevated position (FIG. 8), where the third middle bar 153 is remote from the ground. Each of the first and second jack members 501, 502 may include a jack body 51 driven by a motor 502.

Figure 10:
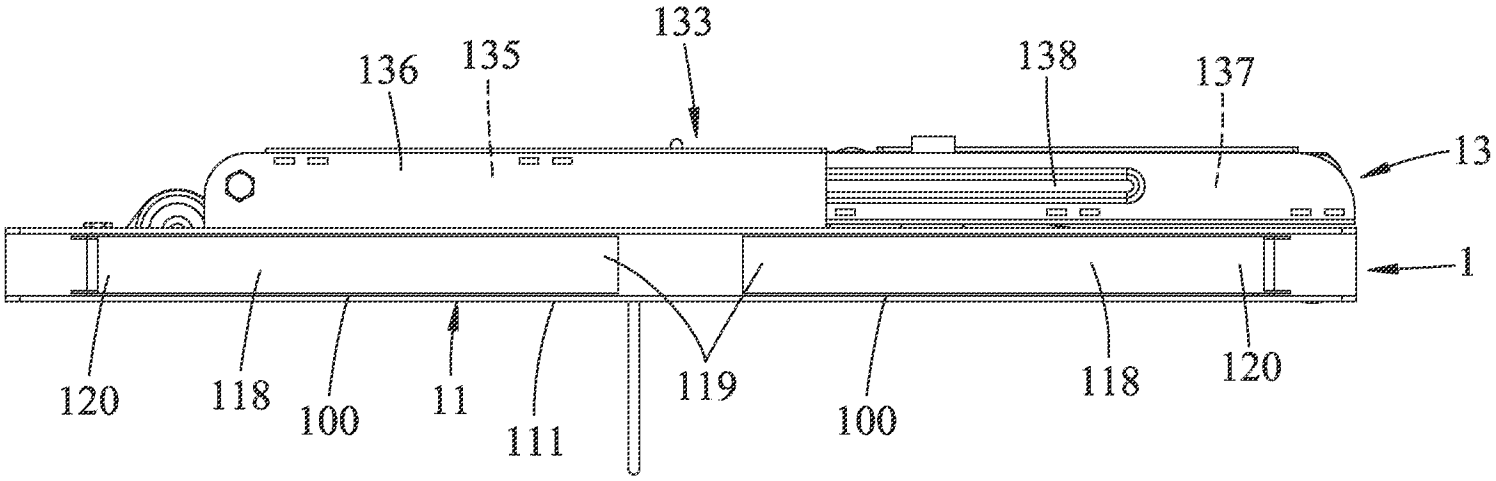
FIG. 10 is a side view illustrating the linkages of the modular bed in a received position.

In an embodiment shown in FIGS. 2, 3, 9, and 10, each of the front and rear end segments 113, 114 of at least one of the left and right beams 111, 112 may be formed with an open groove 100 which faces outwardly. The frame assembly 1 may further include at least two linkages 118 each including a support end 119 and a pivot end 120 which is opposite to the support end 119, and which is pivotally mounted in a respective one of the open grooves 100 of the at least one of the left and right beams 111, 112. Each of the linkages 118 is movable between a received position and a supporting position. In the received position, as shown in FIG. 10, the support end 119 is received in the corresponding open groove 100. In the supporting position, as shown in FIGS. 2, 3, and 9, the support end 119 is disposed outwardly of the corresponding open groove 100.

In an embodiment shown in FIGS. 2, 3, 9, and 10, each of the front and rear end segments 113, 114 of each of the left and right beams 111, 112 may be formed with the open groove 100, and the base frame 11 may include four of the linkages 118. The pivot end 120 of each of the linkages 118 is pivotally mounted in a respective one of the open grooves 100 of the front and rear end segments 113, 114 of the left and right beams 111, 112.

Please note that when the outer tubes 31 of the elongated support units 10 are in the retracted position (FIG. 2), each linkage 118 in the supporting position may define a first included angle of 180° together with the corresponding one of left and right beams 111, 112. When the outer tubes 31 of the elongated support units 10 are in the extended position (FIG. 8), each linkage 118 in the supporting position may define a second included angle together with the corresponding one of left and right beams 111, 112. The second included angle is smaller than the first included angle. The included angle between each linkage 118 and the corresponding one of left and right beams 111, 112 may range from 0° to 180°.

In an embodiment shown in FIGS. 2 and 3, the modular bed may further include a leg assembly 6 configured to elevate and place the frame assembly 1 in a stationary state. The leg assembly 6 may include a plurality of first legs 61 which are detachably mounted beneath the base frame 11, and a plurality of second legs 62 which are detachably and respectively mounted beneath the support ends 119 of the linkages 118 when the support ends 119 of the linkages 118 are in the supporting position. Each of the first and second legs 61, 62 extends in an upright direction (Z).

In an embodiment shown in FIGS. 2 and 3, the frame assembly 1 further includes two telescopic rods 12 each of which extends in the transverse direction (Y), and each of which is detachably connected between the support ends 119 of two front or rear ones of linkages 118 when the support ends 119 of the linkages 118 are in the supporting position.

In an embodiment shown in FIG. 3, each of the telescopic rods 12 may include an inner rod 122 which has two rod end segments, and two outer hollow rods 121 which are slidably and respectively sleeved on the rod end segments of the inner rod 122, and which respectively have two outer ends that are detachably connected between the support ends 119 of two front or rear ones of linkages 118, respectively. When the included angle between each linkage 118 and the corresponding one of left and right beams 111, 112 is greater than 90°, each of the telescopic rods 12 may be adjusted in length so as to connect the support ends 119 of two front or rear ones of linkages 118.

Please note that when the weight of a user lying on the bed mattress 7 causes the vibration motor 45 to put pressure on the stretchable web 42, the stretchable web 42, being coupled to the rack 41, will prevent the vibration motor 45 from being pushed down and keep the vibration motor 45 to abut against a bottom of the bed mattress 7. Consequently, the vibration from the vibration motor 45 may be more effectively transmitted to the user lying on the bed mattress 7.

In addition, because the rack 41 of each of the vibration assemblies 4 may be detachably mounted on any two selected adjacent ones of the elongated support units 10, each of the vibration assemblies 4 may be mounted on the frame assembly 1 at a desired position based on user requirement.

Furthermore, after detaching the positioning members 21 of each elongated support units 10 from the retaining shells 21, the inner and outer tubes 32, 31 of the elongated support unit 10 may be removed from the support frame 13. Next, the retaining shells 22 and the leg assembly 6 may be detached from the frame assembly 1. Thereafter, as shown in FIG. 10, the first bar 135 of each of the left and right bar units 133, 134 (only the left bar unit 133 shown in FIG. 10) may be folded rearwardly on the base frame 11, the first bar 138 of each of the left and right bar units 133, 134 may be folded forwardly on the base frame 11, and each linkage 118 may be received in the corresponding open groove 100 of the base frame 11. As a result, the modular bed may greatly reduce in volume and is more convenient for storage or transportation.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment (s) but is intended to cover various arrangements included within the spirit and scope of the broadest interpretation so as to encompass all such modifications and equivalent arrangements.

What is claimed is:

1. A modular bed for a bed mattress, the modular bed comprising:

a frame assembly;

a plurality of elongated support units which are mounted on said frame assembly, and which are spaced apart from each other in a longitudinal direction for supporting the bed mattress, each of said elongated support units extending in a transverse direction relative to the longitudinal direction; and at least one vibration assembly including a rack disposed on two selected adjacent beams of said elongated support units configured to be movable in the transverse direction such that said rack can be detachably and movably mounted on a selected position on said two selected adjacent beams of said elongated support units, and such that a position of said rack can be varied relative to said frame assembly, said rack having a lower opening, a stretchable web having an upper surface and a lower surface which are located proximate to and distal from the bed mattress, respectively, the stretchable web including a central portion which has a through bore, and two lateral portions which are at two opposite sides of said central portion and which are coupled to said rack to permit said central portion to be suspended across said lower opening, and a vibration motor including a motor body, a positioning plate which has a dimension larger than a dimension of said through bore, and a neck portion which is coupled between said motor body and said positioning plate such that after said through bore is stretched to permit said positioning plate to be inserted through said stretched through bore, resilient retraction of said through bore causes said neck portion to be trapped in said through bore with said motor body and said positioning plate to be in abutting engagement with said upper and lower surfaces of said stretchable web, respectively, wherein said rack has a plate segment having said lower opening, and extending in the longitudinal direction to terminate at a first end region and a second end region, and a first bent end segment and a second bent end segment, which are connected to said first and second end regions of said plate segment, respectively, and which are configured to detachably engage said two selected adjacent beams of said elongated support units, respectively, using a retaining force between the first and second bent segments.

2. The modular bed according to claim 1, wherein each of said elongated support units includes an inner tube having two opposite end segments in the transverse direction, and two outer tubes which are slidably sleeved on said end segments of said inner tube, respectively, and which are slidably retained on said frame assembly.

3. The modular bed according to claim 2, wherein said frame assembly includes a support frame having a front bar which extends in the transverse direction to terminate at a left bar end and a right bar end, a rear bar which extends in the transverse direction to terminate at a left bar end and a right bar end, a left bar unit which extends in the longitudinal direction to interconnect said left bar ends of said front and rear bars, and a right bar unit which extends in the longitudinal direction to interconnect said right bar ends of said front and rear bars; and wherein each of said elongated support units are detachably and respectively mounted to said left and right bar units such that said elongated support units are mounted on said left and right bar units to be displaced from each other in the longitudinal direction.

4. The modular bed according to claim 3, wherein said frame assembly further includes a base frame configured to support said support frame thereon and having a left beam and a right beam, which are spaced apart from each other in the transverse direction, each of said left and right beams having a front end segment, a rear end segment opposite to said front end segment, and a middle segment between said front and rear end segments, a front beam extending in the transverse direction to interconnect said front end segments of said left and right beams, and a rear beam which extends in the transverse direction to interconnect said rear end segments of said left and right beams.

5. The modular bed according to claim 4, wherein each of said left and right bar units includes a first bar having a first rear end and a first front end which is secured to a respective one of said left and right bar ends of said front bar, a second bar disposed rearwardly of said first bar and mounted on said middle segment of a respective one of said left and right beams, said second bar having a second rear end and a second front end, said first rear end being pivotally connected relative to said second front end about a first axis in the transverse direction, a third bar disposed rearwardly of said second bar, and having a third rear end and a third front end which is pivotally connected to said middle segment of the respective one of said left and right beams about a second axis in the transverse direction, and a fourth bar having a fourth rear end which is secured to a respective one of said left and right bar ends of said rear bar, and a fourth front end which is pivotally connected to said third rear end.

6. The modular bed according to claim 5, wherein said support frame further includes a first middle bar interconnecting said first rear ends of said first bars of said left and right bar units so as to permit said first bars of said left and right bar units to turn together relative to said base frame, thereby allowing turning of said front bar about the first axis, a second middle bar interconnecting said third front ends of said third bars of said left and right bar units so as to permit said third bars to turn together relative to said base frame, and a third middle bar interconnecting said third rear ends of said third bars of said left and right bar units so as to permit said third middle bar to turn with said second middle bar about the second axis.

7. The modular bed according to claim 6, further comprising:

a first jack member coupled between said first middle bar and said rear beam so as to permit said front bar to be driven by said first jack member to be liftable about the first axis from a head normal position, where said front bar is close to the ground, to a head elevated position, where said front bar is remote from the ground; and a second jack member coupled between said second middle bar and said front beam so as to permit said third middle bar to be driven by said second jack member to be liftable about the second axis from a leg normal position, where said third middle bar is close to the ground, to a leg elevated position, where said third middle bar is remote from the ground.

8. The modular bed according to claim 4, wherein each of said front and rear end segments of at least one of said left and right beams is formed with an open groove that faces outwardly; and wherein said frame assembly further includes at least two linkages each including a support end and a pivot end which is opposite to said support end, and which is pivotally mounted in a respective one of said open grooves of said at least one of said left and right beams, each of said linkages being movable between a received position, where said support end is received in said corresponding open groove, and a supporting position, where said support end is disposed outwardly of said corresponding open groove.

9. The modular bed according to claim 8, wherein each of said front and rear end segments of each of said left and right beams is formed with said open groove; and wherein said base frame includes four of said linkages, said pivot end of each of said linkages being pivotally mounted in a respective one of said open grooves of said front and rear end segments of said left and right beams.

10. The modular bed according to claim 9, further comprising a leg assembly configured to elevate and place said frame assembly in a stationary state, and including a plurality of first legs which are detachably mounted beneath said base frame, and a plurality of second legs which are detachably and respectively mounted beneath said support ends of said linkages when said support ends of said linkages are in the supporting position.

11. The modular bed according to claim 9, wherein said frame assembly further includes two telescopic rods each of which extends in the transverse direction, and each of which is detachably connected between said support ends of two front or rear ones of linkages when said support ends of said linkages are in the supporting position.

12. The modular bed according to claim 1, wherein said first bent end segment includes a first vertical region extending downwardly from said first end region of said plate segment to terminate at a first lower end, and a first marginal region extending from said first lower end to bend toward said second bent end segment so as to permit said first bent end segment to hook on one of said two selected adjacent beams of said elongated support units; and wherein a second bent end segment includes a second vertical region extending downwardly from said second end region of said plate segment to terminate at a second lower end, and a second marginal region extending from said second lower end to bend away from said first bend end segment so as to permit said second bent end segment to resiliently retain the other one of said two selected adjacent ones of said elongated support units, thereby allowing said rack to be detachably mounted on said two selected adjacent beams of said elongated support units.

13. The modular bed according to claim 1, wherein said plate segment has two first inner margins which are opposite to each other in one of the longitudinal and transverse directions, and two second inner margins which are opposite to each other in the other one of the longitudinal and transverse directions, said first and second inner margins cooperatively defining said lower opening;

wherein said two lateral portions of said stretchable web are disposed on said plate segment to cover said first inner margins, respectively; and wherein said vibration assembly further includes a retaining frame having an upper frame body with an upper opening, and two inserts which are mounted beneath said upper frame body and which are configured such that when said upper frame body is disposed on said stretchable web to register said upper opening with said lower opening, said inserts are permitted to insert through said lower opening to be respectively brought into mating engagement with said second inner margins, thereby allowing said lateral portions of said stretchable web to be coupled to said rack and to be retained between said retaining frame and said rack.

14. The modular bed according to claim 13, wherein said lateral portions of said stretchable web have respectively two enlarged margins configured such that when said stretchable web is retained between said retaining frame and said rack, said enlarged margins are kept at two opposite sides of said upper frame body, to thereby ensure said vibration motor to be suspended by said stretchable web across said lower opening.

15. The modular bed according to claim 1, wherein said vibration assembly further includes a plurality of cushion pads each of which is disposed between said corresponding elongated support unit and said rack.

16. The modular bed according to claim 1, which comprises two of said vibration assemblies that are spaced apart on said frame assembly in the longitudinal direction.

* * * * *